US008172554B2

(12) United States Patent
Yajima

(10) Patent No.: US 8,172,554 B2
(45) Date of Patent: May 8, 2012

(54) CHEMICAL LIQUID SUPPLYING APPARATUS

(75) Inventor: Takeo Yajima, Tokyo (JP)

(73) Assignee: Koganei Corporation, Tokyo (JP)

( * ) Notice: Subject to any disclaimer, the term of this patent is extended or adjusted under 35 U.S.C. 154(b) by 326 days.

(21) Appl. No.: 12/534,190

(22) Filed: Aug. 3, 2009

(65) Prior Publication Data

US 2010/0028179 A1 Feb. 4, 2010

(30) Foreign Application Priority Data

Aug. 4, 2008 (JP) ..... 2008-200672

(51) Int. Cl.
*F04B 9/08* (2006.01)

(52) U.S. Cl. ..... 417/383; 417/394; 417/478; 137/512; 92/171.1; 92/93

(58) Field of Classification Search ..... 417/383, 417/390, 394, 478, 454; 92/171.1, 93; 137/512, 137/533.11
See application file for complete search history.

(56) References Cited

U.S. PATENT DOCUMENTS

| | | | | |
|---|---|---|---|---|
| 3,194,170 | A * | 7/1965 | Ulbing | 417/394 |
| 4,417,861 | A * | 11/1983 | Tolbert | 417/315 |
| 4,886,432 | A * | 12/1989 | Kimberlin | 417/478 |
| 5,992,898 | A * | 11/1999 | Saylor | 285/55 |
| 7,819,436 | B2 * | 10/2010 | Skiba et al. | 285/124.3 |
| 2008/0260549 | A1 | 10/2008 | Yajima | |

FOREIGN PATENT DOCUMENTS

| | | | |
|---|---|---|---|
| JP | 11117872 | A | 4/1999 |
| JP | 2008101510 | A | 5/2008 |

* cited by examiner

*Primary Examiner* — Devon C Kramer
*Assistant Examiner* — Ryan Gatzemeyer
(74) *Attorney, Agent, or Firm* — McCormick, Paulding & Huber LLP

(57) ABSTRACT

In a chemical liquid supplying apparatus, discharge accuracy of chemical liquid is enhanced, and durability of a flexible tube is enhanced. By the flexible tube incorporated into a pump housing, an interior of the pump housing is partitioned into a pump chamber, which communicates with a liquid inlet and a liquid outlet, and a drive chamber in which an incompressible, indirect medium is enclosed. Outer surfaces of end portions of the flexible tube are sealed by outer seal members, and their inner surfaces are sealed by inner seal members. Fastening cylindrical bodies disposed in the end portions of the flexible tube are radially expanded by wedge sleeves, whereby the outer and inner seal members are caused to closely contact with the flexible tube.

10 Claims, 6 Drawing Sheets

CHEMICAL LIQUID SUPPLYING APPARATUS

CROSS-REFERENCE TO RELATED APPLICATIONS

Applicant hereby claims foreign priority benefits under U.S.C. §119 from Japanese Patent Application No. 2008-200672 filed on Aug. 4, 2008, the contents of which are incorporated by reference herein.

TECHNICAL FIELD OF THE INVENTION

The present invention relates to a chemical liquid supplying apparatus which discharges chemical liquid such as photoresist liquid.

BACKGROUND OF THE INVENTION

Before formation of circuit patterns onto a surface of a semiconductor wafer, a polishing processing is performed for flattening the surface of the semiconductor wafer, and when the polishing processing is being performed, polishing liquid is applied onto the surface. When the circuit patterns are formed on the surface after the polishing processing, photoresist or washing liquid is applied onto the surface. As a pump for supplying chemical liquid such as polishing or photoresist liquid to an applied substance, a tube pump having a flexible tube has been used.

The flexible tube is incorporated into a pump housing, thereby partitioning the pump housing into an inner pump chamber and an outer drive chamber. By supplying or exhausting an incompressible, indirect medium to or from the drive chamber, the flexible tube is intended to expand or contract radially and perform a pumping operation. A fixing method of the flexible tube to the pump housing includes a welding type as disclosed in Patent Document 1 (Japanese Patent Application Laid-Open Publication No. 2008-101510), in which both end portions of the flexible tube are deposited or welded to the pump housing, and a fastening type as disclosed in Patent Document 2 (Japanese Patent Application Laid-Open Publication No. 11-117872), in which both end portions of the flexible tube are sandwiched among the pump housing and adaptors fitted into the respective end portions of the flexible tube.

SUMMARY OF THE INVENTION

When the flexible tube starts to perform the pump operation, an elastically deformable portion of the flexible tube expands or contracts radially and, at this time, the elastically deformable portion becomes deformable longitudinally. Since the both end portions of the flexible tube are fixed to the pump housing, when the flexible tube performs the pump operation, an axial-directional center portion of the flexible tube is most deformed radially, whereby the maximum tension is generated in the flexible tube when the center portion is most crushed (pushed). This tension is exerted in a direction of pulling the both end portions of the flexible tube out of the housing.

To improve a yield of the semiconductor wafer, a high-speed supply of the chemical liquid to the semiconductor wafer has been demanded recently. Also, to downsize a chemical liquid supplying pump without changing a discharge amount of the chemical liquid, shortening length of the flexible tube has been demanded. To attain a high-speed operation and the downsizing of the chemical liquid supplying pump, it is required to make high a fixing strength and a seal property of the both end portions of the flexible tube with respect to the pump housing.

To make high the fixing strength of the both end portions of the flexible tube, the above-mentioned welding type is preferable. However, if this welding type is selected as a fixing method, it is required to make quality of a material of the pump housing identical to that of the flexible tube. For example, if the pump housing and the flexible tube are formed of fluorine resins, the welding type can be used. However, if the pump housing is made of metal instead of a fluorine resin, since metal cannot be welded to a fluorine resin, a tube pump of the welding type cannot be produced.

Meanwhile, in order to use the both end portions of the flexible tube as the fastening types, the both end portions are tapered, and the tapered end portions are intended to be sandwiched among the pump housing and the adaptors. If the flexible tube is made of a resin, a creeping phenomenon occurs in the resin, which results in a gradual decrease in the seal properties of the both end portions. The rubber-made flexible tube is more elastic than a resin, and so is better in seal property than a resin. However, when a tension is exerted on the rubber-made flexible tube during its pumping operation, the end portions sandwiched among the pump housing and the adaptors are made thin due to the tension. For this reason, there is the problem that the fastening type cannot be applied to the chemical liquid supplying pump in which the tensions exerted on the end portions tension become strong.

When the seal property of the flexible tube deteriorates, the incompressible, indirect medium in the drive chamber leaks outside, and external air flows in the drive chamber. Therefore, a correspondence relation between an expanding/contracting amount of the drive chamber and a discharging amount of the chemical liquid flowing from an interior of the flexible tube is lost, which results in deterioration of discharging accuracy of the chemical liquid. Also, if the end portions of the flexible tube are not tightly sandwiched among the pump housing and the adaptors, the flexible tube is offset and released from a fastening portion due to the tension during the pumping operation, which results in deterioration of the discharging accuracy of the chemical liquid. In addition thereto, partially exceeding crushes or folding lines are generated in the flexible tube, which results in deterioration of durability of the flexible tube.

An object of the present invention is to enhance discharging accuracy of chemical liquid in a chemical liquid supplying apparatus with a flexible tube.

Another object of the present invention is to enhance durability of the flexible tube.

A chemical liquid supplying apparatus according to the present invention comprises: a pump housing provided with a liquid inlet and a liquid outlet; a flexible tube incorporated into the pump housing, partitioning a pump chamber communicating with the liquid inlet and outlet, and partitioning a drive chamber in which an incompressible, indirect medium is enclosed between the flexible tube and the pump housing; driving means provided to the pump housing, and expanding and contracting the pump chamber via the incompressible, indirect medium; an outer seal member disposed in an inner surface of the pump housing so as to correspond to an end portion of the flexible tube; a fastening cylindrical body, outside which an inner seal member is provided and which is disposed in the end portion of the flexible tube; and a wedge sleeve inserted inside the fastening cylindrical body from an opening end of the pump housing under the condition that the flexible tube is incorporated into the pump housing and that the fastening cylindrical body is incorporated into the end portion, the wedge sleeve causing the fastening cylindrical body to be radially expanded so as to incline by being centered about an inner end of the fastening cylindrical body, and causing the inner and outer seal members to closely contact with the flexible tube.

The chemical liquid supplying apparatus according to the present invention is such that an outer concave-convex portion is formed in the inner surface of the pump housing so as to correspond to the end portion of the flexible tube, an inner concave-convex portion is formed in the fastening cylindrical body so as to correspond to the outer concave-convex portion, and a folding portion, which is folded by the outer and inner concave-convex portions when the wedge sleeve is inserted inside the fastening cylindrical body, is formed in the flexible tube.

A chemical liquid supplying apparatus according to the present invention comprises: a pump housing provided with a liquid inlet port and a liquid outlet; a flexible tube incorporated into the pump housing, partitioning a pump chamber communicating with the liquid inlet and outlet, and partitioning a drive chamber in which an incompressible, indirect medium is enclosed between the flexible tube and the pump housing; driving means provided to the pump housing, and expanding and contracting the pump chamber via the incompressible, indirect medium; an outer seal member disposed in a fitting hole, which is formed in an inner surface of the pump housing, so as to correspond to an end portion having a straight hole larger in diameter than an elastically deformable portion which is a center portion of the flexible tube, and a taper hole located between the elastically deformable portion and the straight hole; and a fastening cylindrical body having a straight outer circumferential surface corresponding to the straight hole and a taper outer circumferential surface corresponding to the taper hole, an outer circumferential surface of the fastening cylindrical body being provided with an inner seal member, and the fastening cylindrical body being disposed in the end portion of the flexible tube, wherein the flexible tube is fastened between the taper outer circumferential surface and the taper hole, and the straight outer circumferential surface is pushed to the straight hole so that the outer and inner seal members are caused to closely contact with the flexible tube.

The chemical liquid supplying apparatus according to the present invention is such that an outer concave-convex portion is formed in an inner circumferential surface of the pump housing so as to correspond to the end portion of the flexible tube, an inner concave-convex portion is formed in the fastening cylindrical body so as to correspond to the outer concave-convex portion, and a folding portion, which is folded by the outer and inner concave-convex portions, is formed in the flexible tube.

The chemical liquid supplying apparatus according to the present invention further comprises a wedge sleeve inserted inside the fastening cylindrical body from an opening end of the pump housing under the condition that the flexible tube is incorporated into the pump housing and that the fastening cylindrical body is incorporated into the end portion, wherein the wedge sleeve causes the fastening cylindrical body to be radially expanded so as to incline by being centered about an inner end of the taper surface, and causes the inner and outer seal members to closely contact with the flexible tube.

The chemical liquid supplying apparatus according to the present invention further comprises a wedge sleeve inserted inside the fastening cylindrical body from an opening end of the pump housing under the condition that the flexible tube is incorporated into the pump housing and that the fastening cylindrical body is incorporated into the end portion, wherein the wedge sleeve causes the fastening cylindrical body to be radially expanded so as to incline by being centered about an inner end of the taper surface, and forms, in the flexible tube, a folding portion that is folded by the outer and inner concave-convex portions. The chemical liquid supplying apparatus according to the present invention further comprises a check valve provided in the fastening cylindrical body.

According to the present invention, the outer surface of the end portion of the flexible tube is sealed by the outer seal member, and its inner surface is sealed by the inner seal member. Therefore, without welding the end portion of the flexible tube to the pump housing, a seal property is enhanced between the inner and outer surfaces of the end portion of the flexible tube, and a leakage of the chemical liquid or indirect medium can be prevented. Accordingly, both end portions of the flexible tube can adopt the fastening type, and the pump housing and the flexible tube can be manufactured using different materials. For example, the pump housing may be made of a metal material, and the flexible tube may be made of a resin material.

According to the present invention, under the condition that the flexible tube is incorporated into the pump housing and that the fastening cylindrical body is incorporated into the end portion of the flexible tube, the fastening cylindrical body is radially expanded by inserting the wedge sleeve inside the fastening cylindrical body which is incorporated into the end portion, and the outer and inner seal members are crushed and caused to closely contact with the end portion of the flexible tube, whereby the seal property can be enhanced. According to the present invention, the fastening cylindrical body is radially expanded by the wedge sleeve, and the folding portion is formed between the fastening cylindrical portion and the pump housing in the flexible tube, whereby the seal property of the end portion of the flexible tube can be enhanced.

According to the present invention, since the seal property of the flexible tube can be enhanced, durability of the flexible tube can be enhanced, and discharge accuracy can be also enhanced.

According to the present invention, since the check valve can be incorporated into the pump housing, the chemical liquid supplying apparatus can be downsized in comparison to a case where the check valve is disposed outside the pump housing. According to the present invention, since the end portion of the flexible tube is firmly fixed to the pump housing, even if a diameter of the flexible tube is set larger than its length, the flexible tube can be prevented from being offset and released from the fastening portion by the tension applied to the flexible tube during the pump operation. Therefore, the discharge accuracy can be enhanced, and the durability of the flexible tube can be improved.

DESCRIPTION OF THE PREFERRED EMBODIMENTS

Hereinafter, embodiments of the present invention will be described in detail based on the accompanying drawings.

Figure 1A:
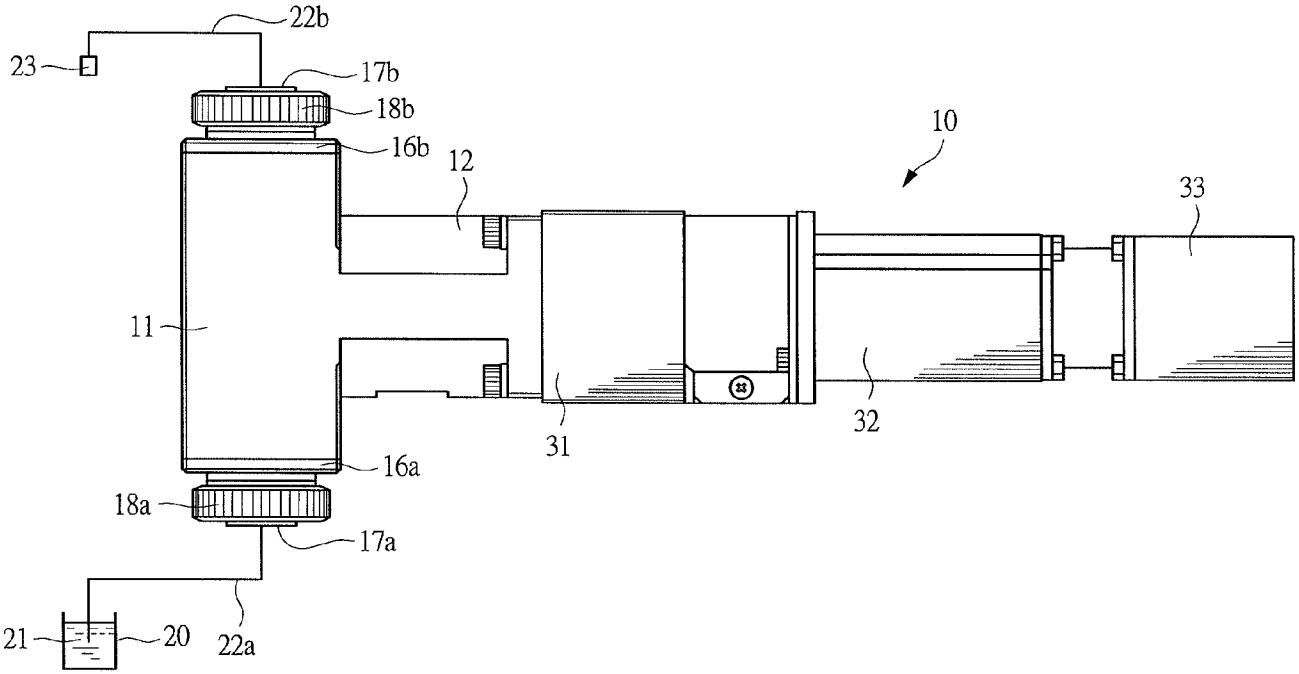
FIG. 1A is an elevational view of a chemical liquid supplying apparatus according to one embodiment of the present invention.
Figure 1B:
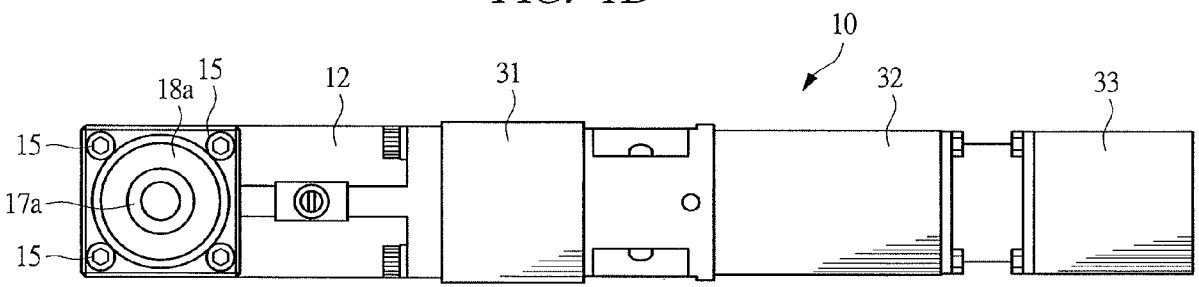
FIG. 1B is a bottom view of FIG. 1A.
Figure 2:
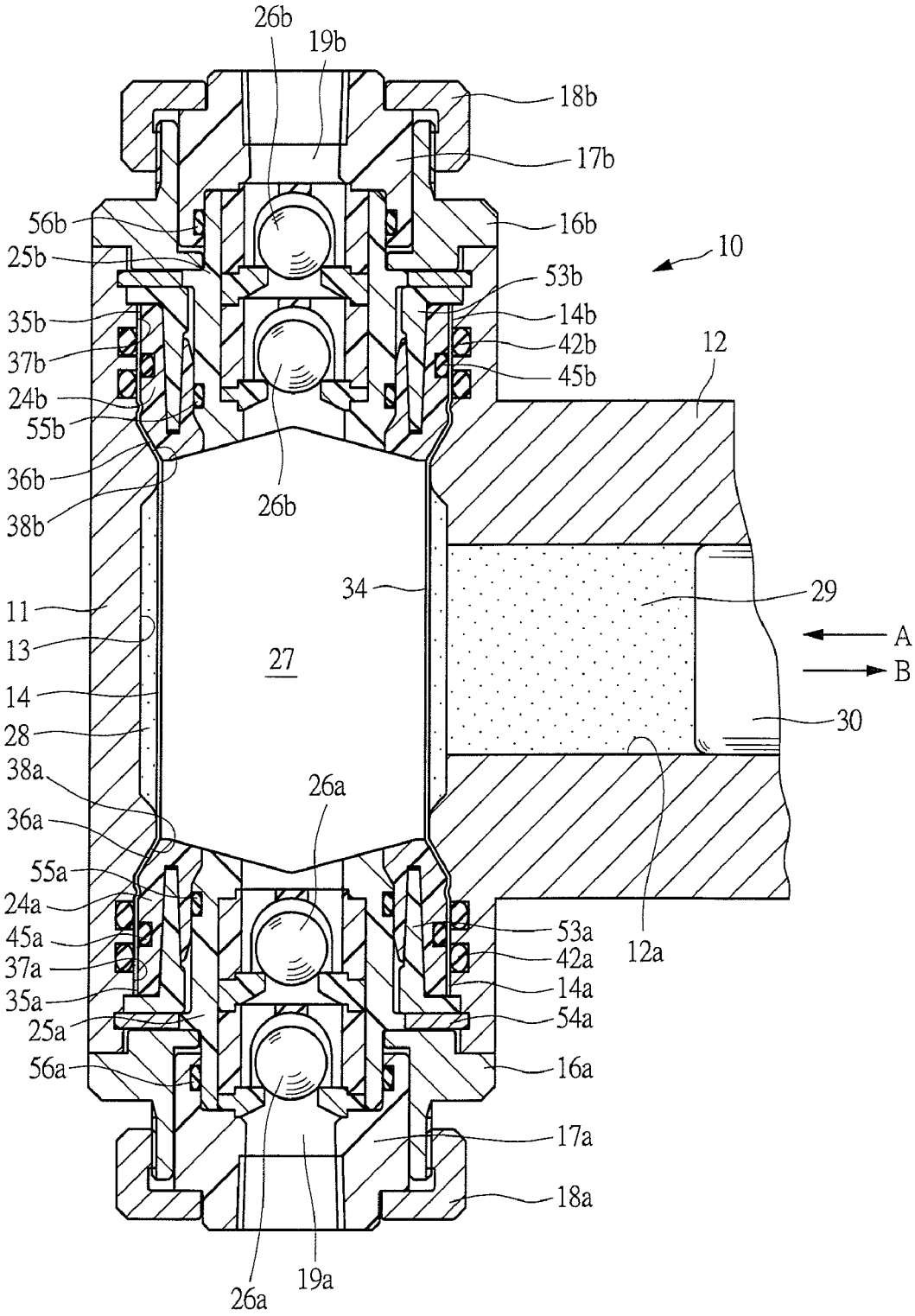
FIG. 2 is a sectional view showing an enlarged portion of FIG. 1A.
Figure 3:
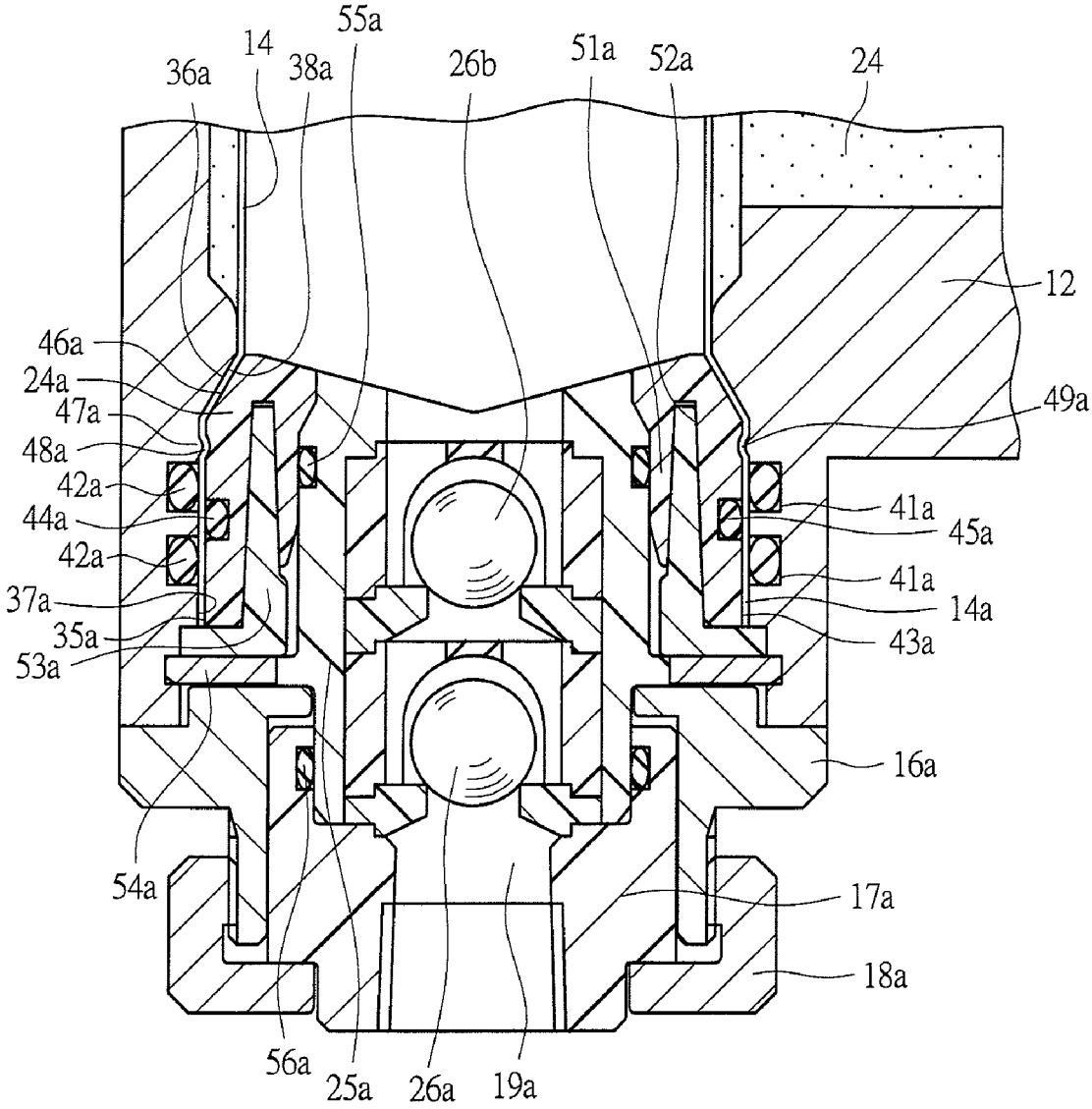
FIG. 3 is a sectional view showing an enlarged inflow-side end portion of a pump housing.
Figure 4:
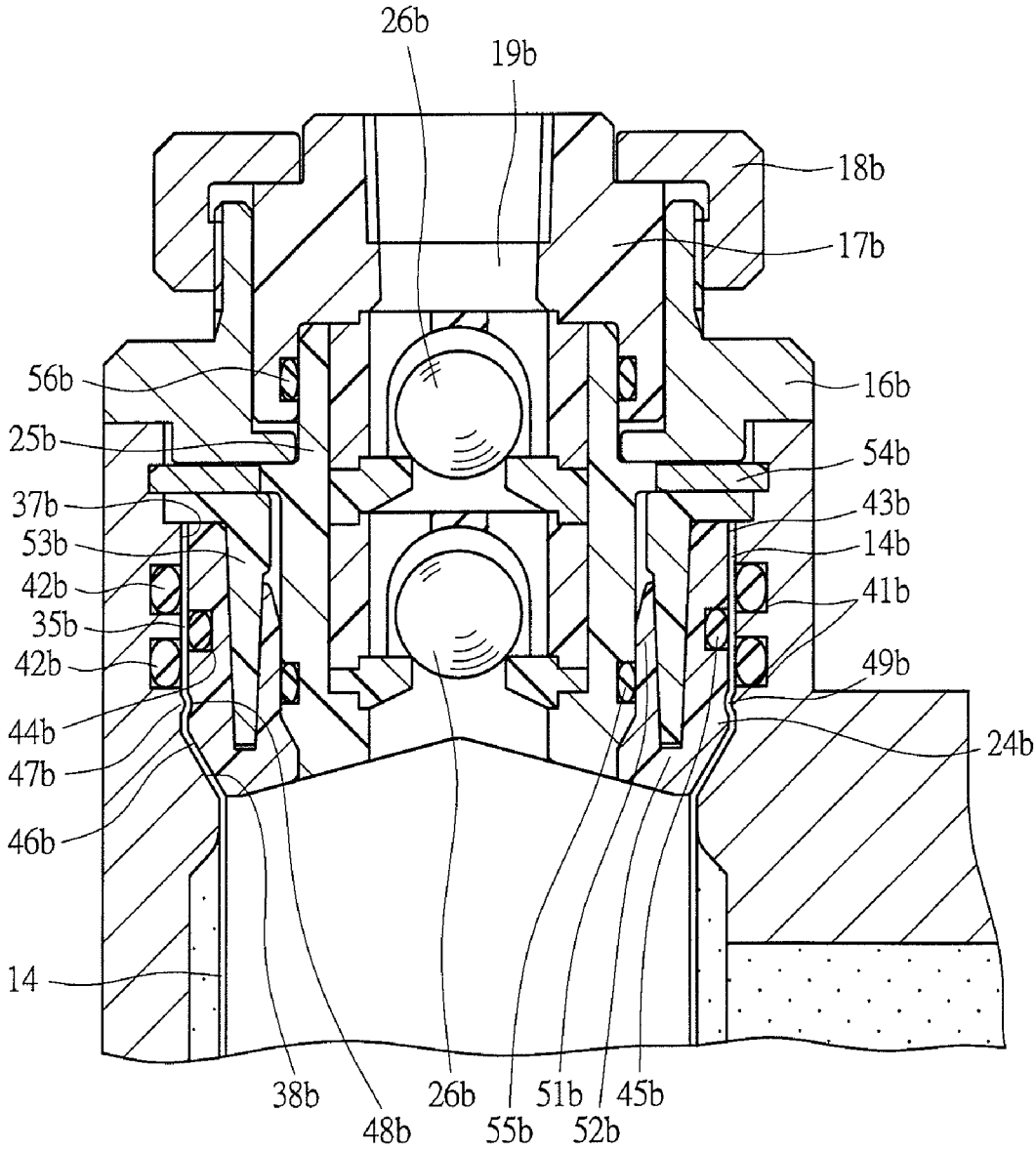
FIG. 4 is a sectional view showing an enlarged outflow-side end portion of the pump housing.

FIG. 1A is an elevational view of a chemical liquid supplying apparatus according to one embodiment of the present invention; FIG. 1B is a bottom view of FIG. 1A; FIG. 2 is a sectional view showing an enlarged portion of FIG. 1A; FIG. 3 is a sectional view showing an enlarged inflow-side end portion of a pump housing; and FIG. 4 is a sectional view showing an enlarged outflow-side end portion of the pump housing.

This chemical liquid supplying apparatus 10 includes a metal-made pump housing 11 whose outline is a substantial rectangular parallelepiped shape. Side walls of the pump housing 11 are provided integrally with a cylinder portion 12, and the cylinder portion 12 protrudes laterally with respect to the pump housing 11. As shown in FIG. 2, a through-hole 13 is formed in the pump housing 11 so as to penetrate longitudinally, and a cylindrical flexible tube 14 is incorporated in the through-hole 13. Both ends of the pump housing 11 are opened. As shown in FIG. 1B, a joint bracket 16*a* is attached to one end portion of the pump housing 11 by bolts 15, and an inflow-side connector 17*a* is fixed to the joint bracket 16*a* by a retaining nut 18*a*. An outflow-side connector 17*b* is fixed, by a retaining nut 18*b*, to a joint bracket 16*b* which is attached to the other end portion of the pump housing 11 by bolts. The inflow-side connector 17*a* has a liquid inlet 19*a* communicating with an interior of the flexible tube 14, and the outflow-side connector 17*b* has a liquid outlet 19*b* communicating with the interior of the flexible tube 14.

As shown in FIG. 1A, intended to be connected to the inflow-side connector 17*a* is a supply-side flow path 22*a* which guides chemical liquid 21 such as photoresist liquid accommodated in a chemical liquid tank 20. Meanwhile, a discharge-side flow path 22*b* is intended to be connected to the outflow-side connector 17*b*, and a tip of the discharge-side flow path 22*b* is provided with a nozzle 23 which discharges the chemical liquid 21. When the chemical liquid supplying apparatus 10 is used for a polishing apparatus for polishing and processing a surface of a semiconductor wafer, polishing liquid is applied as the chemical liquid 21 to the semiconductor wafer from the nozzle 23. When the chemical liquid supplying apparatus 10 is used for an apparatus of forming circuit patterns, photoresist or washing liquid is applied as the chemical liquid to the semiconductor wafer from the nozzle 23.

As shown in FIG. 2, an inflow-side end portion 14*a* of the flexible tube 14 is fixed to the one end portion of the pump housing 11 by a fastening cylindrical body 24*a*, and an outflow-side end portion 14*b* of the flexible tube 14 is fixed to the other end portion of the pump housing 11 by a fastening cylindrical body 24*b*. Cylindrical valve holders 25*a* and 25*b* are incorporated into the fastening cylindrical bodies 24*a* and 24*b*, respectively, and the valve holders 25*a* and 25*b* are provided with two check valves 26*a* and two check valves 26*b*, respectively.

The flexible tube 14, fastening cylindrical bodies 24*a* and 24*b*, and valve holders 25*a* and 25*b* are formed of fluorine resins which are materials not reacting with the chemical liquid 21 such as photoresist liquid. As such a fluorine resin, polytetrafluoroethylene (PTFE) or fluoroethylene perfluoro alkyl vinyl ether copolymer (PFA) has been used. However, the above materials can be variously selected according to a kind of the chemical liquid.

A pump chamber 27 inside and a drive chamber 28 outside the flexible tube 14 are partitioned by the flexible tube 14, and a portion of the flexible tube 14 located between the fastening cylindrical bodies 24*a* and 24*b* deforms radially elastically, thereby performing a pumping operation. The drive chamber 28 communicates with a cylinder hole 12*a* formed in the cylinder portion 12, and an incompressible, indirect medium 29 is enclosed inside the drive chamber 28 and the cylinder hole 12*a*. A piston 30 is mounted axially reciprocably in the cylinder hole 12*a*. When the piston is driven in a direction "A" as shown in FIG. 2, an elastically deformable portion of the flexible tube 14 contracts radially, whereby the pump chamber 27 contracts. Therefore, the chemical liquid in the pump chamber 27 passes the check valve 26*b*, and is discharged via the discharge-side flow path 22*b* from the liquid outlet 19*b* toward the nozzle 23. At this time, the chemical liquid in the pump chamber 27 is prevented from flowing back into the chemical liquid tank 20 by the check valve 26*a*.

Meanwhile, when the piston 30 is driven in a direction "B" as shown in FIG. 2, the elastically deformable portion of the flexible tube 14 expands radially, whereby the pump chamber 27 expands. Therefore, the chemical liquid in the chemical liquid tank 20 flows in the pump chamber 27 via the support-side flow path 22*a*. At this time, the chemical liquid in the discharge-side flow path 22*a* is prevented from flowing toward the pump chamber 27 by the check valve 26*b*.

Thus, the piston 30 serves as driving means for expanding/contracting the pump chamber 27 via the incompressible, indirect medium 29, and, to reciprocate axially the piston 30, as shown in FIG. 1, a drive unit 32 is attached to the cylinder portion 12 of the pump housing 11 via a connecting case 31. The drive unit 32 includes a ball screw rotationally driven by a main shaft of an electric motor 33, and a threaded shaft screwed to the ball screw and reciprocating axially, whereby the threaded shaft is coupled to the piston 30 of the cylinder portion 12.

As shown in FIG. 2, the center portion of the flexible tube 14 serves as the elastically deformable portion 34, and the inflow-side end portion 14*a* includes: a straight section 35*a* larger in diameter than the elastically deformable portion 34 under the condition that the elastically deformable portion 34 is not subjected to a radial-directional exterior force due to the indirect medium 29; and a taper section 36*a* between the elastically deformable portion 34 and the straight section 35*a*. A fitting hole, in which the end portion 14*a* is fitted, is formed in the pump housing 11, and the fitting hole has a straight hole 37*a* corresponding to the straight section 35*a*, and a taper hole 38*a* corresponding to the taper section 36*a*. The outflow-side end portion 14*b* of the flexible tube 14 includes, similarly to the end portion 14*a*, a straight section 35*b* larger in diameter, and a taper section 36*b* between the elastically deformable portion 34 and the straight section 35*b*, wherein a fitting hole, in which the end portion 14*b* is fitted, is formed in the pump housing 11. This fitting hole has a straight hole 37*b* corresponding to the straight section 35*b*, and a taper hole 38*b* corresponding to the taper section 36*b*.

As shown in FIG. 3, two annular grooves 41*a* are formed in an inner circumferential surface of the straight hole 37*a*, and an outer seal member 42*a* serving as an O-ring is disposed in each of the annular grooves 41*a*. The outer seal member 42*a* prevents the indirect medium 29 from leaking out from between the end portion 14*a* of the flexible tube 14 and the pump housing 11. Similarly, as shown in FIG. 4, two annular grooves 41*b* are formed in an inner circumferential surface of the straight hole 37*b*, and an outer seal member 42*b* serving an O-ring is disposed in each of the annular grooves 42*b*. The outer seal member 42*b* prevents the indirect medium 29 from leaking out from between the end portion 14*b* of the flexible tube 14 and the pump housing 11.

As shown in FIG. 3, an annular groove 44*a* is formed in a straight outer circumferential surface 43*a* corresponding to the straight section 35*a* of the flexible tube 14 within an outer circumferential surface of the fastening cylindrical body 24*a*, and an inner seal member 45*a* composed of an O-ring is disposed in the annular groove 44*a*. The inner seal member 45*a* prevents the chemical liquid from leaking out from between the end portion 14*a* of the flexible tube 14 and the fastening cylindrical body 24*a*. Similarly, as shown in FIG. 4, an annular groove 44*b* is formed in a straight outer circumferential surface 43*b* corresponding to the straight section 35*b* of the flexible tube 14 within an outer circumferential surface of the fastening cylindrical body 24*b*, and an inner seal member 45*b* composed of an O-ring is disposed in the annular groove 44*b*. The inner seal member 45*b* prevents the chemical liquid from leaking out from between the end portion 14*b* of the flexible tube 14 and the fastening cylindrical body 24*b*.

As shown in FIG. 3, a taper outer circumferential surface 46*a* is formed in an axial-directional inner end portion of the fastening cylindrical body 24*a* so as to correspond to the taper hole 38*a*. Similarly, as shown in FIG. 4, a taper outer circumferential surface 46*b* is formed in an axial-directional inner end portion of the fastening cylindrical body 24*b* so as to correspond to the taper hole 38*b*. Accordingly, when the fastening cylindrical bodies 24*a* and 24*b* are incorporated into the end portions 14*a* and 14*b* of the flexible tube 14 in a state of causing the taper outer circumferential surfaces 46*a* and 46*b* to abut on the taper holes 38*a* and 38*b*, the straight outer circumferential surfaces 43*a* and 43*b* of the fastening cylindrical bodies 24*a* and 24*b* are pushed toward the straight holes 37*a* and 37*b*. Therefore, the outer seal members 42*a* and 42*b* and the inner seal members 45*a* and 45*b* are caused to closely contact with the end portions 14*a* and 14*b* of the flexible tube 14, respectively, whereby a seal property is ensured between them.

As shown in FIGS. 3 and 4, projection portions 47*a* and 47*b*, which protrude radially inward and serve as outer concave-convex portions, are formed in the inner circumferential surfaces of the straight holes 37*a* and 37*b* of the pump housing 11, and annular grooves 48*a* and 48*b* serving as inner concave-convex portions are formed in the straight outer circumferential portions 43*a* and 43*b* of the fastening cylindrical bodies 24*a* and 24*b* so as to correspond to the projection portions 47*a* and 47*b*, respectively. Accordingly, when the fastening cylindrical bodies 24*a* and 24*b* are fitted in the end portions 14*a* and 14*b*, folding portions 49*a* and 49*b*, which have been folded by the projection portions 47*a* and 47*b* and the annular grooves 48*a* and 48*b*, are formed in the straight sections 35*a* and 35*b* of the flexible tube 14. By the folding portions 49*a* and 49*b*, the indirect medium 29 and the chemical liquid 21 are prevented from leaking out. Also, the flexible tube 14 can be tightly fixed.

Incidentally, by inverting a concave-convex relation between the outer concave-convex portion and the inner concave-convex portion, annular grooves serving as outer concave-convex portions may be formed in the inner circumferential surfaces of the straight holes 37*a* and 37*b*, and projection portions serving as inner concave-convex portions may be formed in the straight outer circumferential surfaces 43*a* and 43*b*.

As shown in FIGS. 3 and 4, guide cylindrical bodies 51*a* and 51*b*, which are formed into cylindrical shapes, are provided inside the fastening cylindrical bodies 24*a* and 24*b*, respectively, and the guide cylindrical bodies 51*a* and 51*b* are integrated with the fastening cylindrical bodies 24*a* and 24*b* at their inner-axial ends, respectively. Between the guide cylindrical bodies 51*a* and 51*b* and the fastening cylindrical bodies 24*a* and 24*b*, guide grooves 52*a* and 52*b* which have taper shapes are formed respectively so that gaps therebetween are gradually increased toward an opening portion of the pump housing 11. Cylindrical wedge sleeves 53*a* and 53*b*, which have taper shapes correspondingly to the guide grooves 52*a* and 52*b*, are intended to be inserted into the guide grooves 52*a* and 52*b*, and the wedge sleeves 53*a* and 53*b* are fixed respectively to the pump housing 11 by stopper rings 54*a* and 54*b* which are engaged with the annular grooves formed in the pump housing 11.

Figure 5B:
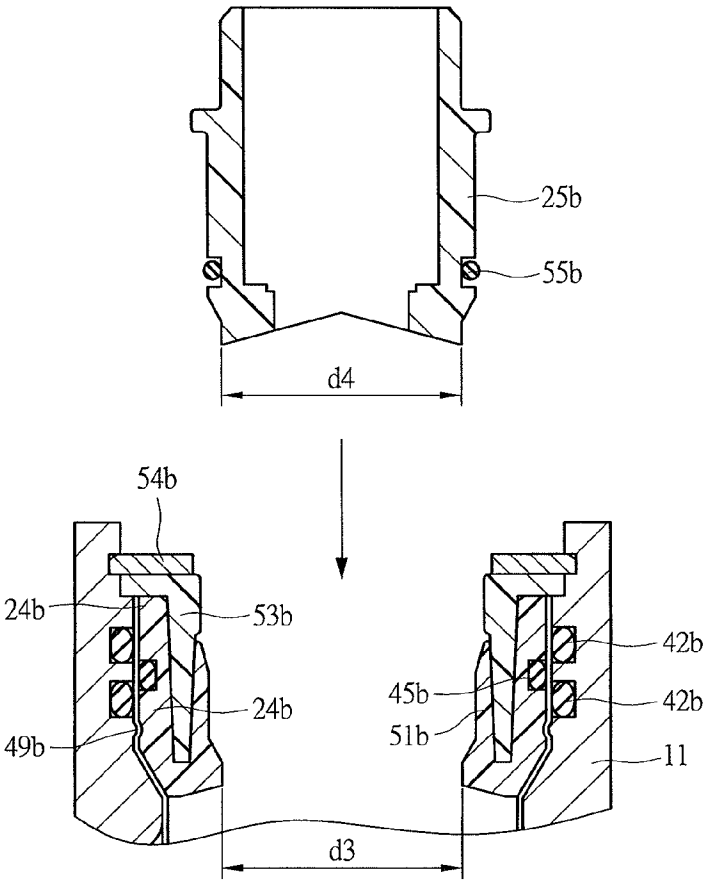
FIG. 5B is a sectional view showing an assembling procedure of the fastening cylindrical body and the wedge sleeve.
Figure 5A:
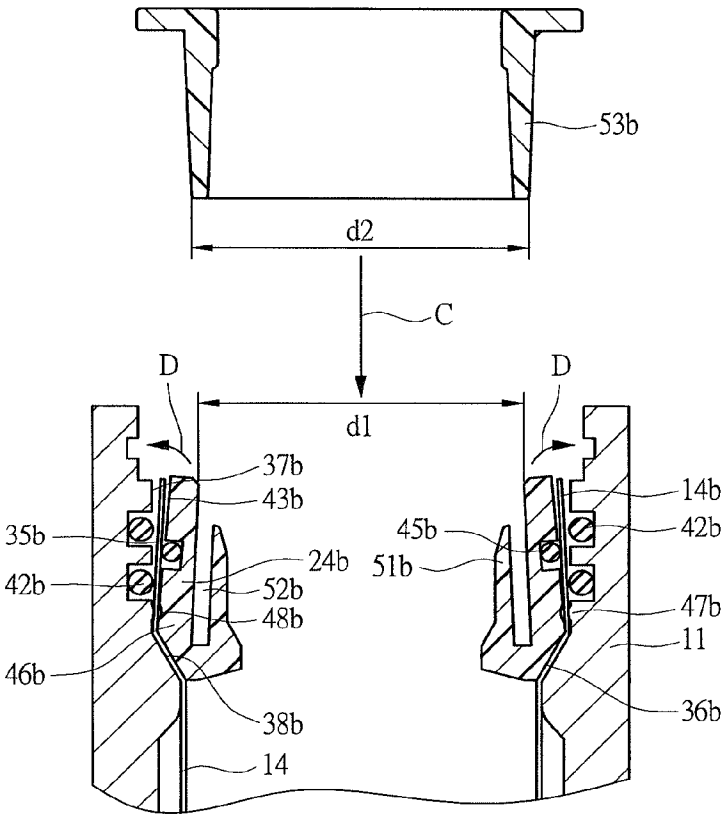
FIG. 5A is a sectional view showing an assembling procedure of a fastening cylindrical body and a wedge sleeve.

FIGS. 5A and 5B are sectional views showing an assembling procedure of the fastening cylindrical body 24*b* and the wedge sleeve 53*b*. As shown by an arrow "C" in FIG. 5A, under the condition that the flexible tube 14 is incorporated into the pump housing 11, and that the fastening cylindrical body 24*b* is incorporated into the end portion 14*b* of the flexible tube 14, the wedge sleeve 53*b* is inserted inside the fastening cylindrical body 24*b* from an opening end portion of the pump housing 11. When the fastening cylindrical body 24*b* integrated with the guide cylindrical body 51*b* is shaped (molded) by a resin material, an outer diameter on an outer-axial end side as shown in FIG. 5A is smaller in size than that of an inner-axial end side. At this time, an inner diameter "d1" of an outer end of the fastening cylindrical body 24*b* is substantially equal to or slightly smaller than a tip-side outer diameter "d2" of the wedge sleeve 53*b*.

When the wedge sleeve 53*b* is inserted, a diameter of the fastening cylindrical body 24*b* is expansively changed by being centered about its inner-axial end in a direction of inclining radially outwards as shown by an arrow "D" in FIG. 5A. Therefore, the outer seal members 42*b* and the inner seal member 45*b* are radially crushed and are elastically deformed as shown in FIG. 5B, and are caused to closely contact with the end portion 14*b* of the flexible tube 14, whereby the seal property is enhanced between the indirect medium 29 and the chemical liquid 21. When the wedge sleeve 53*b* is inserted into the fastening cylindrical body 24*b*, the folding portion 49*b* is further formed in the end portion 14*b* due to the projection portion 47*b* and the annular groove 48*b*, whereby the seal property is enhanced between the indirect medium 29 and the chemical liquid 21 also by the folding portion 49*b*. Particularly, in the wedge sleeve 53*b*, since the inner-axial end portion is narrow and its outer circumferential surface is tapered, an inserting force of the wedge sleeve 53*b* is increased due to a wedge effect, whereby the folding portion 49*b* can be certainly formed, by the weak inserting force, in the flexible tube 14 which is made of a hard resin. As shown in FIG. 5B, The wedge sleeve 53*b* is fixed to the pump housing 11 by the stopper ring 54*b*.

After the wedge sleeve 53*b* is attached to the pump housing 11 in a manner as described above, as shown in FIG. 5B, the valve holder 25*b* is incorporated inside the end portion 14*b* of the flexible tube 14. An inner diameter of "d3" of an inner-axial end of the guide cylindrical body 51*b* is substantially equal to a tip-side outer diameter "d4" of the valve holder 25*b*, and when the valve holder 25*b* is fitted inside the guide cylindrical body 51*b*, the chemical liquid 21 is prevented from leaking out from between the valve holder 25*b* and the guide cylindrical body 51*b* by a seal member 55*b* provided to the valve holder 25*b*.

FIGS. 5A and 5*b* have each shown the fastening cylindrical body 24*b* and the wedge sleeve 53*b* which are incorporated into the end portion 14*b* of the flexible tube 14 located on a liquid-outflow side. However, the same structure as the above-mentioned one is adopted also regarding the end portion 14*a* located on a liquid-inflow side opposite to the end portion 14*b*, wherein, as shown in FIG. 3, the valve holder 25*b* is provided with a seal member 55*a*.

As shown in FIGS. 3 and 4, the check valves 26*a* and 26*b* are incorporated into the valve holders 25*a* and 25*b*, respectively, and the valve holders 25*a* and 25*b* and the check valves 26*a* and 26*b* are positioned by the connectors 17*a* and 17*b* and fixed by the retaining nuts 18*a* and 18*b*. Thus, the check valves 26*a* and 26*b* are incorporated into the pump housing 11, whereby the chemical liquid supplying apparatus 10 including the check valves can be downsized in dimension. The connectors 17*a* and 17*b* are provided with seal members 56*a* and 56*b* for preventing a leakage of the chemical liquid 21 which passes through check valves 26*a* and 26*b*.

Figure 6:
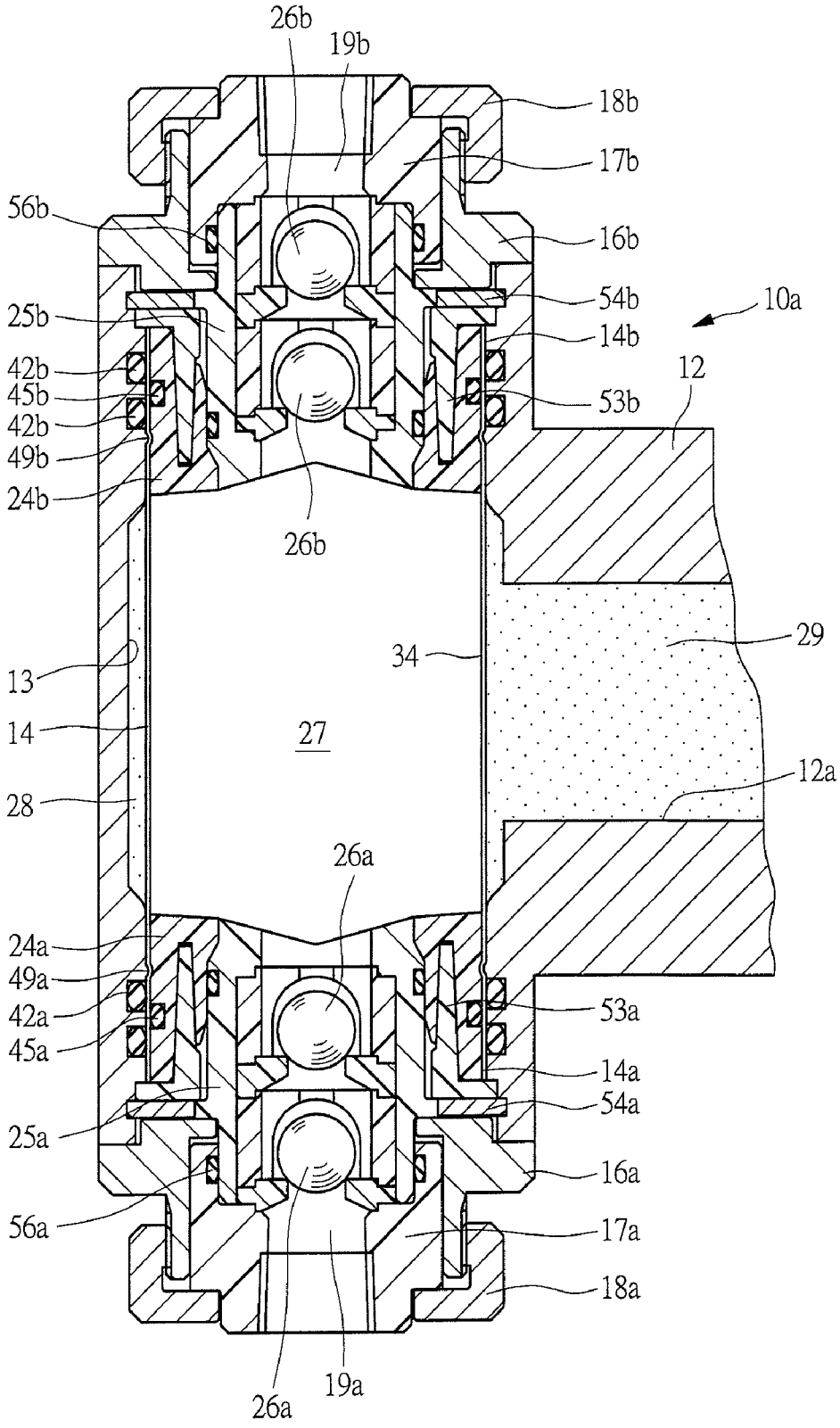
FIG. 6 is a sectional view showing a chemical liquid supplying apparatus according to another embodiment of the present invention.

FIG. 6 is a sectional view showing a chemical liquid supplying apparatus 10*a* according to another embodiment of the present invention. The both end portions 14*a* and 14*b* of the flexible tube 14 in this chemical liquid supplying apparatus 10*a* are different from those of the chemical liquid supplying apparatus 10 as shown in FIG. 2, and have the same diameter as that of the elastically deformable portion 34. Thus, even if elements constituting the flexible tube 14 overall have the same diameter, when the wedge sleeves 53*a* and 53*b* are inserted inside the fastening cylindrical bodies 24*a* and 24*b* from an opening end of the pump housing 11 under the condition that the flexible tube 14 and incorporated into the pump housing 11 and that the fastening cylindrical bodies 24*a* and 24*b* are incorporated into the end portions 14*a* and 14*b*, the fastening cylindrical bodies 24*a* and 24*b* radially expand so as to incline by being centered about respective inner ends of the fastening cylindrical bodies, and the inner seal members 45*a* and 45*b* and the outer seal members 42*a* and 42*b* closely contact with to the flexible tube 14, respectively, whereby the seal property can be enhanced therebetween. In addition thereto, since the folding portions 49*a* and 49*b* are formed in the flexible tube 14, the seal property can be further enhanced.

If the straight sections 35*a* and 35*b* and the taper sections 36*a* and 36*b* are provided to the both end portions 14*a* and 14*b* similarly to the flexible tube 14 of the chemical liquid supplying apparatus 10 shown in FIG. 2, the taper sections 36*a* and 36*b* are fastened by pushing and inserting the fastening cylindrical bodies 24*a* and 24*b* into the pump housing 11, whereby the seal property is enhanced. Further, when the wedge sleeves 53*a* and 53*b* are inserted inside the fastening cylindrical bodies 24*a* and 24*b*, since the fastening cylindrical bodies 24*a* and 24*b* are positioned by the taper sections 36*a* and 36*b*, inserting operations of the wedge sleeves 53*a* and 53*b* become easy.

Thus, as shown in FIGS. 2 and 6, the flexible tube 14 made of a hard resin such as a fluorine resin can be firmly fixed to the metal pump housing 11 while the seal property therebetween is being ensured. Such firm fixture as mentioned above can prevent the flexible tube from being offset and released from the fastening portion due to the tension applied to the flexible tube during the pumping operation, whereby the discharge accuracy can be enhanced, and the durability of the flexible tube can be improved.

As a modification of the chemical liquid supplying apparatus, there is a type in which the folding portions 49*a* and 49*b* are provided on an axial-directional outer side with respect to the outer seal members 42*a* and 42*b*. Further, as shown in FIG. 2, if the taper sections 36*a* and 36*b* are provided to the flexible tube 14, there is a type in which at least one set of the inner seal members and the outer seal members is caused to closely contact with the taper sections 36*a* and 36*b*.

The present invention is not limited to the above embodiments, and can be variously altered and modified within a scope of not departing from the gist thereof. For example, driving means for expanding and contracting the pump chamber 27 is not limited to the piston 30, and a bellows or diaphragm may be used as the above means.

What is claimed is:

1. A chemical liquid supplying apparatus comprising:

a pump housing provided with a liquid inlet and a liquid outlet;

a flexible tube incorporated into the pump housing, partitioning a pump chamber communicating with the liquid inlet and outlet, and partitioning a drive chamber in which an incompressible, indirect medium is enclosed between the flexible tube and the pump housing;

driving means provided to the pump housing, and expanding and contracting the pump chamber via the incompressible, indirect medium;

an outer seal member disposed in an inner surface of the pump housing so as to correspond to an end portion of the flexible tube;

a fastening cylindrical body, outside which an inner seal member is provided and which is disposed in the end portion of the flexible tube; and a wedge sleeve inserted inside the fastening cylindrical body from an opening end of the pump housing under the condition that the flexible tube is incorporated into the pump housing and that the fastening cylindrical body is incorporated into the end portion of the flexible tube, the wedge sleeve causing the fastening cylindrical body to be expanded toward the inner surface of the pump housing, and causing the inner and outer seal members to closely contact with the flexible tube.

2. The apparatus according to claim 1, wherein an outer concave-convex portion is formed in the inner surface of the pump housing so as to correspond to the end portion of the flexible tube, an inner concave-convex portion is formed in the fastening cylindrical body so as to correspond to the outer concave-convex portion, and a folding portion, which is folded by the outer and inner concave-convex portions when the wedge sleeve is inserted inside the fastening cylindrical body, is formed in the flexible tube.

3. A chemical liquid supplying apparatus comprising:

a pump housing provided with a liquid inlet and a liquid outlet;

a flexible tube incorporated into the pump housing, partitioning a pump chamber communicating with the liquid inlet and outlet, and partitioning a drive chamber in which an incompressible, indirect medium is enclosed between the flexible tube and the pump housing;

driving means provided to the pump housing, and expanding and contracting the pump chamber via the incompressible, indirect medium;

an outer seal member disposed in a fitting hole, which is formed in an inner surface of the pump housing, so as to correspond to an end portion having a straight hole larger in diameter than an elastically deformable portion which is a center portion of the flexible tube, and a taper hole located between the elastically deformable portion and the straight hole; and a fastening cylindrical body having a straight outer circumferential surface corresponding to the straight hole and a taper outer circumferential surface corresponding to the taper hole, an outer circumferential surface of the fastening cylindrical body being provided with an inner seal member, and the fastening cylindrical body being disposed in the end portion of the flexible tube, wherein the flexible tube is fastened between the taper outer circumferential surface and the taper hole, and the straight outer circumferential surface is pushed to the straight hole so that the outer and inner seal members are caused to closely contact with the flexible tube.

4. The apparatus according to claim 3, wherein an outer concave-convex portion is formed in an inner circumferential surface of the pump housing so as to correspond to the end portion of the flexible tube, an inner concave-convex portion is formed in the fastening cylindrical body so as to correspond to the outer concave-convex portion, and a folding portion, which is folded by the outer and inner concave-convex portions, is formed in the flexible tube.

5. The apparatus according to claim 3, further comprising a wedge sleeve inserted inside the fastening cylindrical body from an opening end of the pump housing under the condition that the flexible tube is incorporated into the pump housing and that the fastening cylindrical body is incorporated into the end portion, wherein the wedge sleeve causes the fastening cylindrical body to be radially expanded so as to incline by being centered about an inner end of the taper surface, and causes the inner and outer seal members to closely contact with the flexible tube.

6. The apparatus according to claim 4, further comprising a wedge sleeve inserted inside the fastening cylindrical body from an opening end of the pump housing under the condition that the flexible tube is incorporated into the pump housing and that the fastening cylindrical body is incorporated into the end portion, wherein the wedge sleeve causes the fastening cylindrical body to be radially expanded so as to incline by being centered about an inner end of the taper surface, and forms, in the flexible tube, a folding portion that is folded by the outer and inner concave-convex portions.

7. The apparatus according to claim 1, further comprising a check valve provided in the fastening cylindrical body.

8. The apparatus according to claim 3, further comprising a check valve provided in the fastening cylindrical body.

9. The apparatus according to claim 1, wherein the wedge sleeve is formed into a cylindrical shape, and an outer diameter of a distal end of the wedge sleeve is smaller than that of a base end of the wedge sleeve.

10. The apparatus according to claim 9, wherein a guide cylindrical body is provided inside the fastening cylindrical body and integrated with the fastening cylindrical body at its inner-axial end, wherein a tapered guide groove is formed between the guide cylindrical body and the fastening cylindrical body, and the wedge sleeve is inserted in the guide groove.

* * * * *